United States Patent [19]

Pagalies

[11] Patent Number: 4,470,197

[45] Date of Patent: Sep. 11, 1984

[54] LETTERING GUIDE

[76] Inventor: Hans-Günther Pagalies, Ronsdorfer Str. 7, Düsseldorf, Fed. Rep. of Germany

[21] Appl. No.: 425,868

[22] Filed: Sep. 28, 1982

[30] Foreign Application Priority Data

Oct. 12, 1981 [DE] Fed. Rep. of Germany ..... 3140471

[51] Int. Cl.[3] ..... B44D 3/30; B43B 13/00

[52] U.S. Cl. ..... 33/174 B; 434/87

[58] Field of Search ..... 33/1 D, 174 B, 174 G, 33/477; 434/87, 164

[56] References Cited

U.S. PATENT DOCUMENTS

| | | | |
|---|---|---|---|
| 2,152,904 | 4/1939 | McNeil | 33/174 B |
| 3,568,327 | 3/1971 | Furuoka | 33/174 B |
| 3,633,286 | 1/1972 | Maurer | 434/87 |

FOREIGN PATENT DOCUMENTS

| | | | |
|---|---|---|---|
| 586564 | 11/1959 | Canada | 33/174 B |
| 816807 | 8/1952 | Fed. Rep. of Germany . | |
| 1764557 | 4/1963 | Fed. Rep. of Germany . | |
| 2020423 | 11/1971 | Fed. Rep. of Germany | 33/174 B |
| 758958 | 1/1934 | France | 33/174 B |
| 1288209 | 2/1962 | France | 33/174 B |
| 1392011 | 2/1965 | France | 33/174 B |

*Primary Examiner*—Richard R. Stearns

*Attorney, Agent, or Firm*—Karl F. Ross; Herbert Dubno

[57] ABSTRACT

A lettering guide for the tracing of alphanumerical characters comprises an elongate rectangular frame to be placed on a receiving surface such as a sheet of paper or cardboard, the frame accommodating a slider which is transversely shiftable in its opening to align a horizontal strip of the receiving surface with either of two sets of cutouts (e.g. for the tracing of capital and lower-case letters, respectively) formed in an elongate template. This template is longitudinally displaceable beneath a rectangular window of the slider in confronting parallel grooves of two bars of the latter extending along the major sides of the frame, the grooves lying below the level of the minor frame sides. A row of closely spaced indentations along an edge of the template are yieldably engageable by detents on the slider for indexing the template in selected working positions enabling a substantially uniform spacing of traced characters of different widths.

8 Claims, 10 Drawing Figures

LETTERING GUIDE

FIELD OF THE INVENTION

My present invention relates to a lettering guide designed to facilitate the tracing of alphanumerical characters on a sheet of paper, a glass pane, a board or any other receiving surface.

BACKGROUND OF THE INVENTION

German Pat. No. 816,807 describes a lettering guide comprising an elongate frame with a rectangular opening whose major dimension extends in a direction of a line of characters to be inscribed on the receiving surface, i.e. horizontally as is true in most instances and as will be assumed hereinafter. In a direction perpendicular thereto, i.e. vertical in the case of an upright surface, the frame opening has a width considerably exceeding the height of a line of characters; an elongate slider somewhat narrower than the frame opening is vertically displaceable therein between two limiting positions adjacent the horizontal frame members. The slider has a horizontally extending window which is bounded by two bars paralleling the major frame members and accommodates a rectangular template, also extending horizontally with its major dimension, which is guided in confronting longitudinal grooves of the bars and is formed with one or two rows of cutouts enabling the tracing of selected characters. With two rows of cutouts respectively representing lower-case and capital letters, a shift of the slider between its two limiting positions facilitates the tracing of letters from either row on a given line of the receiving surface. The frame also carries a pressure bar, normally held elevated above the slider by coil springs, from which a multiplicity of pins project downward to engage in respective holes of the template to index same in a working position; the holes are equispaced along the template and are in line with respective characters thereof. Thus, a user having traced one character in one of these working positions will be able to trace the next character in another working position so chosen that the tracings on the receiving surface will have uniform center-to-center spacing or pitch.

This type of uniformity, however, is not always desirable. Since some characters such as M and W are much wider than others such as I or l, consecutive narrower characters will have greater separation than wider ones. Furthermore, characters with two distinct apertures or "eyes" (such as B or 8) require plural cutouts for their tracing which necessarily appear on the template at different locations that must be successively brought into the selected writing position. The device described above does not provide for this possibility.

OBJECT OF THE INVENTION

The object of my present invention, therefore, is to provide an improved lettering guide of the general type described which affords greater flexibility in the positioning of the characters, including that of synthesizing a character from tracings of different cutouts.

SUMMARY OF THE INVENTION

A lettering guide according to my invention has the same basic components as the device of the above-identified German patent, namely an elongate frame with a slider received in its opening and an elongate template movable in a window of the slider, the template being formed with two longitudinally extending rows of character-tracing cutouts respectively registering with a given line (i.e. a horizontal strip) of a receiving surface in the two limiting positions in the slider. The template is provided with a row of indexing formations which parallel the rows of cutouts and are engageable by detent means on the slider in respective relative working positions, the indexing formations being spaced apart with a pitch equal to a fraction of the maximum width of the cutouts for establishing potential working positions separated by distances unrelated to the width of the characters to be traced.

Pursuant to a more particular feature of my invention, the detent means may comprise a pair of projections near opposite ends of the slider, at least one projection being maintained in yieldable contact with one of the indexing formations in any working position. This eliminates the need for an extra operating step, such as the depression of an indexing bar according to the device of the German patent, and insures a proper positioning regardless of the direction in which the template is laterally extended beyond the slider. The indexing formations and the associated detent means may have various mutually complementary shapes; it will generally be desirable to have female indexing formations in the template mate with male indexing formations on the slider, though a reverse arrangement could also be used. In a particularly simple construction, more fully described hereinafter, the indexing formations are indentations in a major edge of the template coacting with resilient tongues which are disposed in one of the guide grooves of the slider.

BRIEF DESCRIPTION OF THE DRAWING

The above and other features of my invention will now be described in detail with reference to the accompanying drawing in which.

SPECIFIC DESCRIPTION

Figure 3:
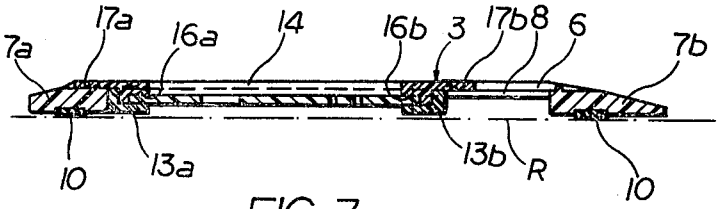
FIG. 3 is a cross-sectional view taken on the line III—III of FIG. 1.

A lettering guide according to my invention, as illustrated in FIGS. 1–6, comprises a rectangular frame 1 with a major horizontal dimension, the frame having an opening 5 bounded by longitudinal members *7a*, *7b* and transverse members 6. As best seen in FIG. 3, longitudinal members *7a* and *7b* have undersides provided with friction pads 10 of hard rubber or the like by which they rest on a receiving surface or substrate R; the transverse members 6, on the other hand, are elevated above that surface. Shelves 8 projecting inward from transverse members 6 serve as guides for a slider 3, also of elongate rectangular configuration, whose width is somewhat less than that of frame opening 5 and which is therefore shiftable between two limiting positions in which two longitudinal bars 13*a*, 13*b*, bounding a rectangular window 24, respectively adjoin frame members 7*a* and 7*b*; the latter position is the one illustrated in FIG. 1. Bars 13*a*, 13*b* have longitudinal grooves 16*a*, 16*b* receiving respective major edges of an elongate rectangular template 4 which is horizontally slidable therein. Components 1, 3 and 4 advantageously consist of transparent or semitransparent plastic material.

Figure 10:
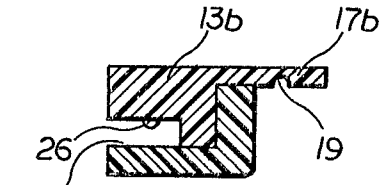
FIGS. 9 and 10 are cross-sectional views, drawn to a larger scale, respectively taken on lines IX—IX and X—X of FIG. 7.

As will be apparent from FIG. 3, and as seen even more clearly in FIG. 10, each bar 13*a*, 13*b* of slider 3 consists of two interfitting parts one of which forms a shelf 17*a*, 17*b* overhanging the corresponding frame member 7*a*, 7*b* in a respective limiting position; this shelf is formed on its underside with a groove 19 into which a rib 12 on the associated frame member releasably engages. Formations 12 and 19 could, however, be omitted if the frictional fit between the shelf and the frame member is sufficient to maintain the slider in its selected "upper" or "lower" position, i.e. adjacent frame member 7*a* or 7*b*. Bars 13*a* and 13*b* are interconnected by cross-pieces 14 whose top surfaces are flush with those of transverse frame members 6.

Figures 1, 2, 8:
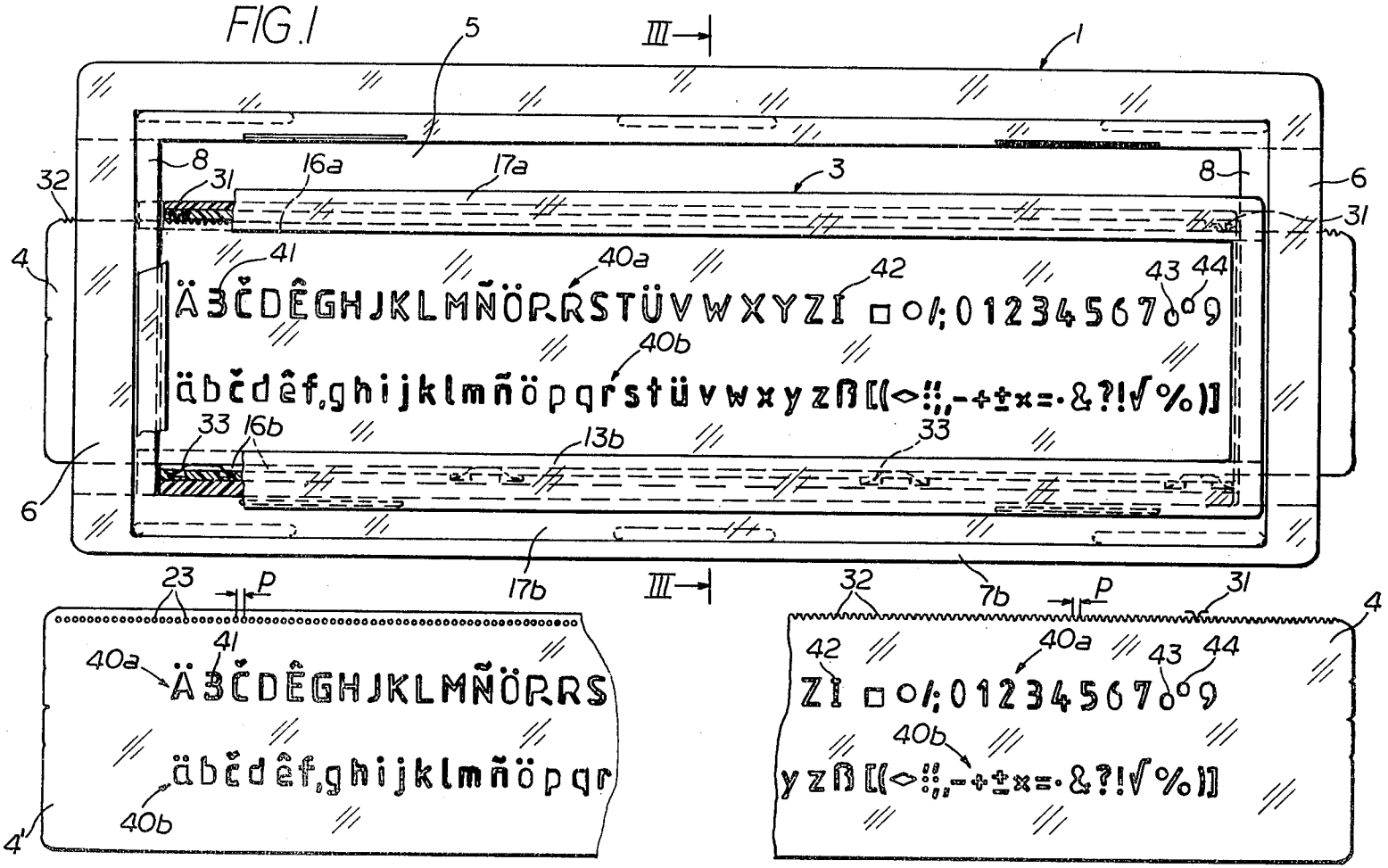
FIG. 1 is a face view of a lettering guide embodying my invention.
FIG. 2 is a fragmentary face view of a template forming part of the assembly of FIG. 1.
FIG. 8 is a fragmentary face view of the template coacting with the slider of FIG. 7.

In the embodiment of FIGS. 1–6, slider 3 is provided with two resilient tongues 31 which are disposed at opposite ends of its grooves 16*a* and coact with triangular indentations 32 formed along a longitudinal edge of template 4 received in that groove. The other groove 16*a* is fitted with wire springs 33 which bear upon the opposite longitudinal edge of template 4 to urge its indented edge into contact with the bottom of groove 16*a* and thus into engagement of one or two of its indentations 32 with either or both tongues 31, depending on whether the template is in the centered position of FIG. 1 or has been partly pulled out to either side. With a multiplicity of springs 33 as illustrated in FIG. 1, the template will always have the proper horizontal attitude regardless of its position relative to slider 3 as long as its "lower" edge contacts at least two of these springs.

Template 4 is formed with two rows of cutouts 40*a*, 40*b* for the tracing of alphanumerical characters; row 40*a* serves for drawing capital letters as well as numerals whereas row 40*b* is designed for lower-case letters and various mathematical and other symbols. Cutouts representing diacritical marks are also provided in each row. The effective width of each cutout is at least one pitch p (FIG. 2) of indentations 32; some of them extend over four or five such pitches. A peculiarity of the cutouts of row 40*a* is that it enables the synthesization of letter B by the successive use of two cutouts 41 and 42 (that one also serving to trace the letter I) and of numeral 8 with the aid of two cutouts 43 and 44; in the latter instance, for example, the user may first place the template 4 in a working position in which the lower loop of the "8" can be traced at the desired location of substrate R with the aid of cutout 43 whereupon the template 4 is shifted to the left by a sufficient number of pitches p (two in the present instance) to place the cutout 44 above the loop just drawn for the tracing of the upper loop. Whenever a selected character or symbol has been traced, the next one can be drawn in a new working position with an intervening separation of one or more pitches p, as desired. The characters may thus be drawn on the substrate with uniform spacing regardless of their individual widths.

Figure 7:
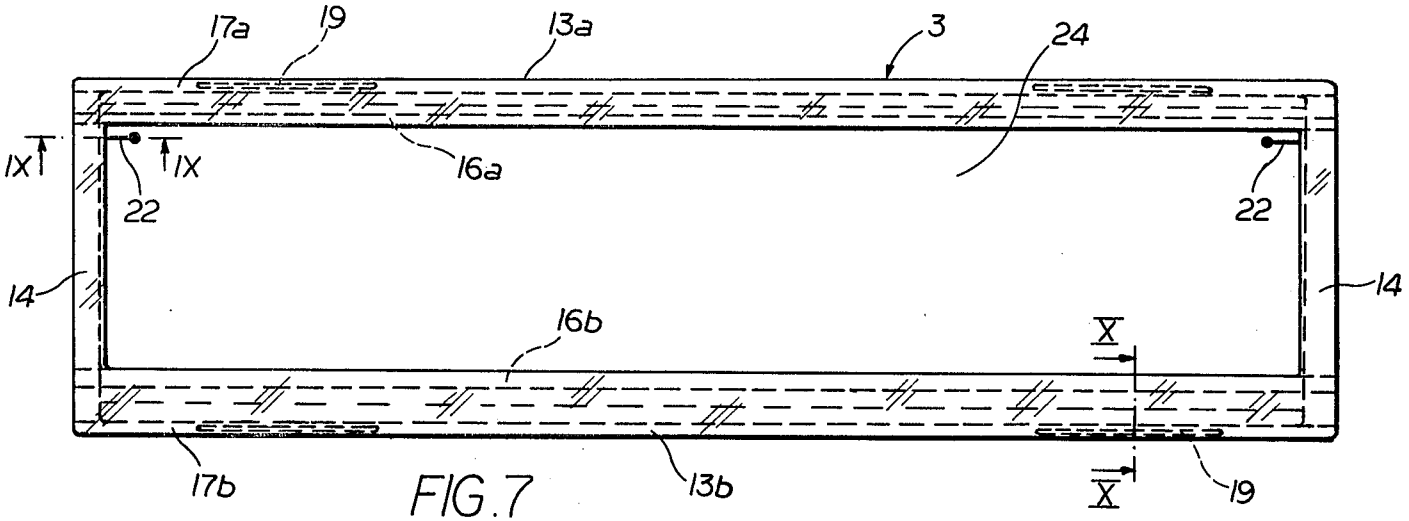
FIG. 7 is a face view of a slider similar to one shown in FIG. 1 but slightly modified to coact with a different template.
Figure 9:
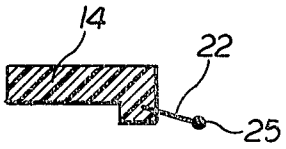
Figure 4:
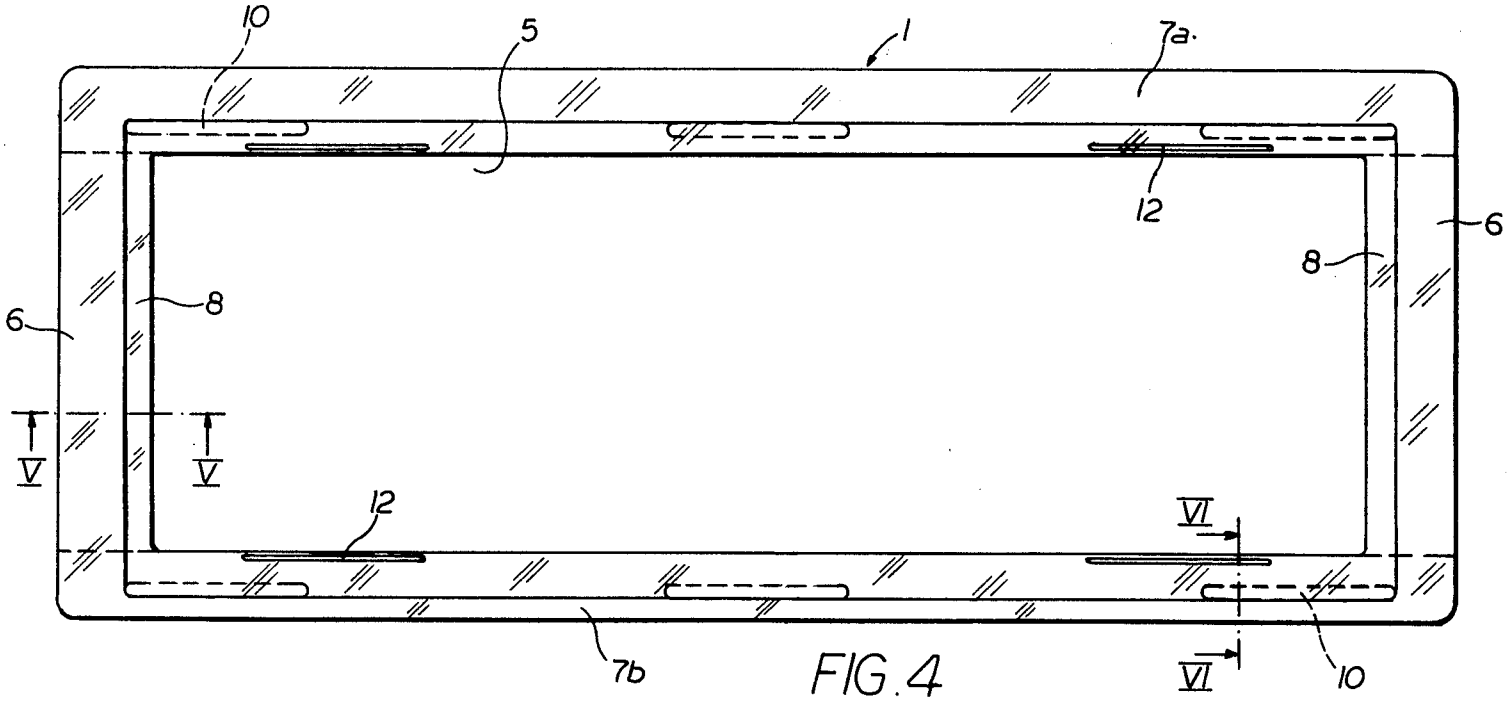
FIG. 4 is a face view of a rectangular frame forming part of the assembly.
Figure 6:
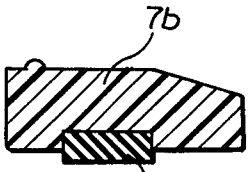
FIG. 6 is a similarly enlarged cross-sectional view taken on the line VI—VI of FIG. 4.
Figure 5:
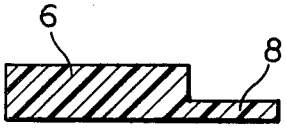
FIG. 5 is a cross-sectional view taken on the line V—V of FIG. 4 and drawn to a larger scale.

A modified template 4' shown in FIG. 8 differs from template 4 in that indentations 32 have been replaced by a row of surface depressions 23 of the same uniform pitch p. In this instance, and as shown in FIGS. 7 and 9, slider 3 lacks the tongues 31 of the preceding embodiment but is provided instead with resilient detent lugs 22 projecting inward into its window 24 from cross-pieces 14 in line with depressions 23. In each working position, one or two of these depressions are yieldably engaged by either or both lugs 22 to stabilize the template as in the previous instance. Detents 22 are short metallic blades which are partly embedded in members 14 during the molding process and terminate in rounded heads 25. Springs 33 in groove 16*b* may also be used in this instance to help stabilize the template in the window 24 of the slider.

A further type of detent, illustrated in FIG. 10, comprises two bumps 26 in bar 13*b* projecting into its groove 16*b* near opposite ends thereof to coact with a row of depressions 23 provided in that instance in a lower marginal zone of the template, rather than in an upper marginal zone as shown in FIG. 8. The bumps 26 will fulfill the same function as the heads 25 of detents 22.

In a practical realization of a lettering guide as shown in FIGS. 1–6, designed for the drawing of characters in lines 10 mm high, the pitch p is 1 mm and the window 24 has a height of 4 cm; the height of the frame opening 5 is slightly greater than 7 cm.

I claim:

1. A lettering guide facilitating the tracing of alphanumerical characters on a receiving surface, comprising:

an elongate frame with a rectangular opening extending with its major dimension in a direction of a line of characters to be inscribed on the receiving surface, said opening having a width encompassing several lines of characters, said opening being bounded by two longitudinal members with undersides adapted to rest on said receiving surface and by two transverse members with bottom surfaces raised above said undersides;

an elongate slider received in said opening and guided by said transverse members for displacement therein between two limiting positions respectively adjoining said longitudinal members, said slider having a rectangular window bounded by two bars paralleling said longitudinal members and by two cross-pieces adjoining said transverse members, said bars being provided with confronting longitudinal grooves below the level of said cross-pieces, said window having a width exceeding the combined height of two of said lines of characters; and an elongate template slidably received in said grooves and provided with two longitudinally extending rows of cutouts enabling the tracing of selected characters, said rows respectively registering with a given line on said receiving surface in said limiting positions, said template having a major edge provided with a row of indentations constituting indexing formations paralleling said rows of cutouts, said slider carrying detent means engageable with different ones of said indexing formations in respective working positions of said template relative to said slider, said indexing formations being spaced apart with a pitch equal to a fraction of the maximum width of said cutouts for establishing potential working positions separated by distances unrelated to the width of said characters.

2. A lettering guide as defined in claim 1 wherein said detent means comprises a pair of projections near opposite ends of said slider, at least one of said projections being maintained in yieldable contact with one of said indexing formations in any of said working positions.

3. A lettering guide as defined in claim 1 or 2 wherein said undersides are provided with surface-gripping means.

4. A lettering guide as defined in claim 1 or 2 wherein said bars are provided with outer flanges each overlying one of said longitudinal members in one of said limiting positions, respectively, said flanges and said longitudinal members having retaining formations releasably interengaging in the respective limiting positions.

5. A lettering guide facilitating the tracing of alphanumerical characters on a receiving surface, comprising:

an elongate frame with a rectangular opening extending with its major dimension in a direction of a line of characters to be inscribed on the receiving surface, said opening having a width encompassing several lines of characters, said opening being bounded by two longitudinal members with undersides adapted to rest on said receiving surface and by two transverse members with bottom surfaces raised above said undersides;

an elongate slider received in said opening and guided by said transverse members for displacement therein between two limiting positions respectively adjoining said longitudinal members, said slider having a rectangular window bounded by two bars paralleling said longitudinal members and by two cross-pieces adjoining said transverse members, said bars being provided with confronting longitudinal grooves below the level of said cross-pieces, said window having a width exceeding the combined height of two of said lines of characters; and an elongate template slidably received in said grooves and provided with two longitudinally extending rows of cutouts enabling the tracing of selected characters, said rows respectively registering with a given line on said receiving surface in said limiting positions, said template being provided with a row of indexing formations paralleling said rows of cutouts, said slider carrying detent means engageable with different ones of said indexing formations in respective working positions of said template relative to said slider, said indexing formations being spaced apart with a pitch equal to a fraction of the maximum width of said cutouts for establishing potential working positions separated by distances unrelated to the width of said characters, said bars being provided with outer flanges each overlying one of said longitudinal members in one of said limiting positions, respectively, said flanges and said longitudinal members having retaining formations releasably interengaging in the respective limiting positions.

6. A lettering guide as defined in claim 5 wherein said indexing formations are indentations in a major edge of said template.

7. A lettering guide as defined in claim 1 or 6 wherein said detent means comprises a pair of resilient tongues disposed in one of said grooves near opposite ends thereof.

8. A lettering guide as defined in claim 7 wherein the other of said grooves is provided with resilient means urging said major edge into said one of said grooves.

* * * * *